US009841250B1

(12) United States Patent
Mirza

(10) Patent No.: US 9,841,250 B1
(45) Date of Patent: Dec. 12, 2017

(54) FIREARM COVERS

(71) Applicant: Iurie Mirza, Washougal, WA (US)

(72) Inventor: Iurie Mirza, Washougal, WA (US)

( * ) Notice: Subject to any disclaimer, the term of this patent is extended or adjusted under 35 U.S.C. 154(b) by 0 days.

(21) Appl. No.: 15/367,748

(22) Filed: Dec. 2, 2016

(51) Int. Cl.
*F41A 17/00* (2006.01)
*F41A 17/32* (2006.01)
*F41A 35/02* (2006.01)

(52) U.S. Cl.
CPC ..... *F41A 17/32* (2013.01); *F41A 35/02* (2013.01)

(58) Field of Classification Search
CPC ..... F41A 17/32; F41A 35/02; F41A 17/44; F41A 35/04; F41A 17/54; F41A 17/46; F41A 17/74; F41A 17/56; F41A 17/64
USPC ..... 42/70.11, 96
See application file for complete search history.

(56) References Cited

U.S. PATENT DOCUMENTS 1,513,267 A * 10/1924 Parks ..... F41A 17/02 42/70.11
2,364,340 A * 12/1944 Bogg, Jr. ..... F41A 35/02 42/106
2,599,689 A * 6/1952 Brelsford ..... F41A 35/02 359/511
2,932,334 A * 4/1960 Steen ..... F41A 35/02 206/317
3,191,652 A * 6/1965 Benson ..... F41C 33/06 206/317
3,307,755 A * 3/1967 Lentz ..... F41C 33/06 206/317
3,902,639 A 9/1975 Rogers
4,348,829 A * 9/1982 Bosco ..... F41A 35/02 42/96
4,398,367 A * 8/1983 Gamble ..... F41A 35/02 42/96
D372,121 S * 7/1996 Rowe ..... D3/262
5,621,996 A * 4/1997 Mowl, Jr. ..... F41A 23/18 211/64
5,680,723 A * 10/1997 Ruiz ..... F41A 17/44 42/70.07
D392,364 S * 3/1998 Neal ..... D22/100
5,768,819 A * 6/1998 Neal ..... F41A 17/00 42/70.07
6,142,313 A * 11/2000 Young ..... F41A 17/02 211/4
6,164,004 A * 12/2000 Essary ..... F41A 35/02 42/96

(Continued)

*Primary Examiner* — Joshua Freeman
(74) *Attorney, Agent, or Firm* — Dascenzo Intellectual Property Law, P.C.; Ian D. Gates

(57) ABSTRACT

Firearm covers are disclosed. A firearm cover includes a body defining a partially enclosed region sized and shaped to receive a firearm receiver of a firearm. The body includes a first side wall having a first lip and a second side wall opposite the first side wall and having a second lip. The first lip and the second lip define a longitudinal opening to the partially enclosed region. The first side wall and the second side wall define a forward opening to the partially enclosed region and a rear opening to the partially enclosed region such that, when the firearm receiver is operatively received in the partially enclosed region, the firearm extends through the forward opening and the rear opening. The firearm cover further includes structure for restricting the firearm from being fired when the firearm receiver is operatively received in the partially enclosed region.

23 Claims, 6 Drawing Sheets

(56) References Cited

U.S. PATENT DOCUMENTS

| | | | | |
|---|---|---|---|---|
| 6,260,300 | B1 * | 7/2001 | Klebes | F41A 17/066 206/317 |
| 2002/0116856 | A1 * | 8/2002 | Troyer | F41A 17/54 42/70.11 |
| 2002/0194763 | A1 * | 12/2002 | Olsen | F41A 17/44 42/70.11 |
| 2003/0005614 | A1 * | 1/2003 | Cossio | F41A 35/04 42/96 |
| 2003/0066228 | A1 * | 4/2003 | Smith | F41A 17/54 42/70.11 |
| 2007/0062090 | A1 * | 3/2007 | Brindle | F41A 35/02 42/96 |
| 2008/0120888 | A1 * | 5/2008 | Matyko | F41A 17/02 42/70.11 |
| 2010/0281748 | A1 * | 11/2010 | Parry, Jr. | F41A 35/02 42/96 |
| 2016/0054083 | A1 * | 2/2016 | Kiyani | F41A 17/063 42/70.11 |

* cited by examiner

FIREARM COVERS

FIELD

The present disclosure relates to firearm covers.

BACKGROUND

In the sports of firearm shooting and hunting, as well as in military and civilian firearm training, it may be desirable to disable a firearm in such a way that it is visually apparent that the firearm is temporarily incapable of being fired. As an example, a firing range may enforce rules that dictate that a firearm be rendered inoperative in a visually verifiable manner before the firearm may be transported to or from a firing stall. Moreover, outside of firing ranges, it is paramount that firearms be handled in a safe manner, whether during hunting activities or during firearm training, for example. However, traditional means of rendering a firearm inoperative, such as securing the firearm in a case, may be cumbersome or inconvenient in various circumstances.

SUMMARY

The present disclosure relates to firearm covers, such as may be used to restrict a firearm from being fired. A firearm cover includes a body defining a partially enclosed region sized and shaped to receive at least a portion of a firearm receiver of a firearm and configured to transition between a clamped conformation and an open conformation, with the body being biased toward the clamped conformation. In the clamped conformation, the body is retained on the firearm receiver, and in the open conformation, the body is configured to be selectively placed over and removed from the firearm receiver. The body includes a first side wall having a first lip and a second side wall opposite the first side wall and having a second lip. The first side wall is configured to at least partially cover a first side of the firearm receiver when the firearm receiver is operatively received in the partially enclosed region, and the second side wall is configured to at least partially cover a second side of the firearm receiver when the firearm receiver is received in the partially enclosed region. The first lip and the second lip define a longitudinal opening to the partially enclosed region between the first lip and the second lip. The first lip and the second lip are spaced further apart in the open conformation than in the clamped conformation. The first side wall and the second side wall define a forward opening to the partially enclosed region and a rear opening to the partially enclosed region such that, when the firearm receiver is operatively received in the partially enclosed region, the firearm extends through the forward opening and the rear opening. The body further includes a connecting region extending between the first side wall and the second side wall. The firearm cover further includes means for restricting the firearm from being fired when the firearm receiver is operatively received in the partially enclosed region.

DESCRIPTION

Figure 1:
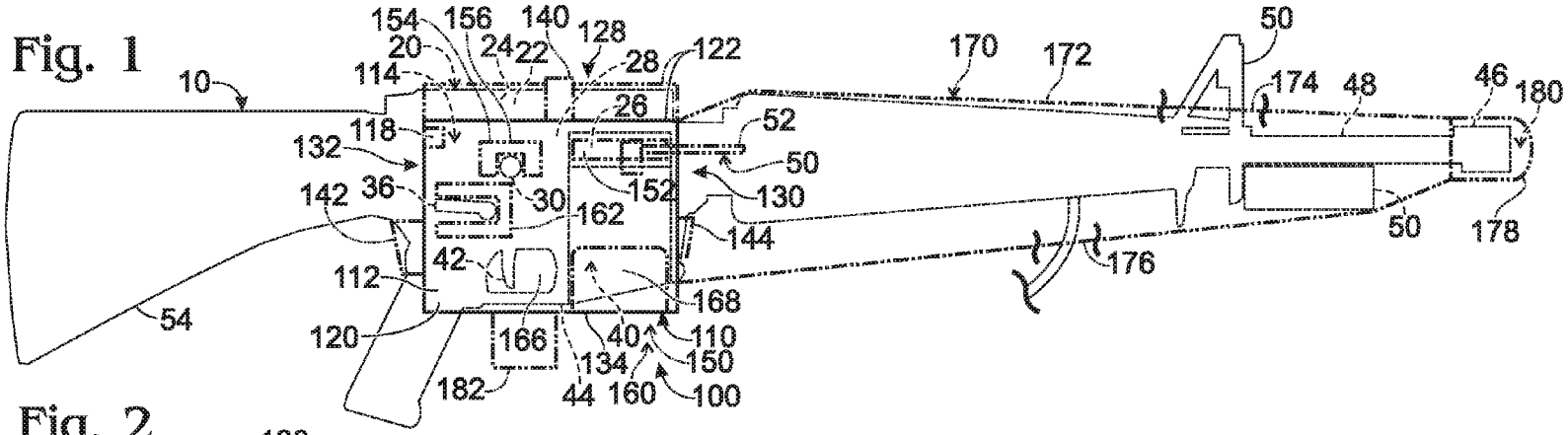
FIG. 1 is a schematic right side elevation view representing a firearm cover installed on a firearm.

FIGS. 1-13 provide illustrative, non-exclusive examples of firearm covers 100, of components and/or features of firearm covers 100, and/or of firearm covers 100 installed on firearms 10, according to the present disclosure. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numerals associated therewith may be utilized herein for consistency. Elements, components, and/or features that are discussed herein with reference to one or more of FIGS. 1-13 may be included in and/or utilized with any of FIGS. 1-13 without departing from the scope of the present disclosure.

Figure 2:
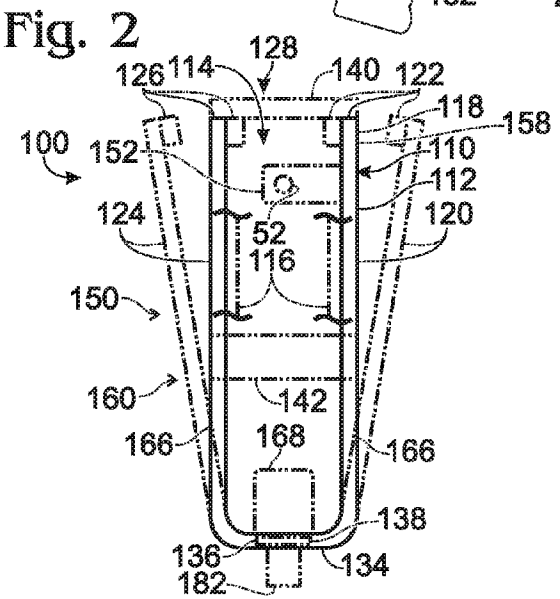
FIG. 2 is a schematic rear elevation view representing the firearm cover of FIG. 1.

Generally, in FIGS. 1-2, elements that are likely to be included in a given example are illustrated in solid lines, while elements that are optional to a given example are illustrated in broken lines. However, elements that are illustrated in solid lines are not essential to all examples of the present disclosure, and an element shown in solid lines may be omitted from a particular example without departing from the scope of the present disclosure.

FIGS. 1-2 are schematic representations of firearm covers 100. Specifically, FIG. 1 is a schematic right side view representing a firearm cover 100 installed on a firearm 10, and FIG. 2 is a schematic rear view representing the firearm cover. In FIG. 1, firearm 10 is schematically represented as a magazine-fed semi-automatic rifle; however, firearm covers 100 may be configured for use with any configuration or style of firearms, including firearms and rifles not explicitly illustrated in the drawings. As illustrated in FIG. 1, firearm 10 includes a firearm receiver 20 that has a first receiver side 22 and a second receiver side 24. As used herein, firearm receiver 20 also may be referred to as a receiver 20, and generally refers to the component and/or portion of firearm 10 that includes a firing mechanism of the firearm. As illustrated in FIG. 1, first receiver side 22 may refer to a right side of receiver 20 and/or second receiver side 24 may refer to a left side of receiver 20. However, this is not required, and it is within the scope of the present disclosure that first receiver side 22 and second receiver side 24 may refer to any appropriate respective sides, faces, and/or components of receiver 20.

In some firearms 10, receiver 20 includes a magazine well 40 configured to receive a magazine of ammunition. As an example, firearm 10 may be configured to fire ammunition in the form of an ammunition cartridge that includes a bullet and a shell, and the magazine may be configured to carry a plurality of ammunition cartridges. Firearm 10 and/or receiver 20 may include a hammer that may be selectively cocked and/or decocked, and/or may include a trigger 42 that may be selectively actuated to fire a bullet, such as by releasing the hammer from a cocked position and/or by otherwise causing a primer of the ammunition cartridge to be ignited. Upon being fired, the bullet may pass through a barrel 48 of firearm 10 such that the bullet exits the firearm through a muzzle 46 of the barrel. Firearm 10 and/or receiver 20 also may include an ejection port 26 through which the shell of the ammunition cartridge may be expelled upon firing. In some embodiments of firearm 10, such as an embodiment that lacks magazine well 40, ejection port 26 additionally or alternatively may refer to an aperture through which an ammunition cartridge may be loaded into receiver 20. In such an embodiment, ejection port 26 additionally or alternatively may be referred to as a loading port 26.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As further illustrated in FIG. 1, firearm 10 and/or receiver 20 additionally may include a bolt 28 configured to restrict a rear end of barrel 48. Bolt 28 may be selectively translated in a fore-aft direction, such as to permit an ammunition cartridge to enter barrel 48 (such as via magazine well 40 and/or ejection port 26) and/or to at least substantially isolate barrel 48 from magazine well 40 and/or from ejection port 26. More specifically, bolt 28 may be selectively translated between a forward position, in which firearm 10 may be fired, and an aft (or rearward) position, in which an ammunition cartridge may be inserted into barrel 48 and in which the firearm is incapable of being fired. Stated differently, firearm 10 may be said to be disabled from being fired when bolt 28 is restricted from reaching the forward position.

In some firearms 10, such as so-called bolt-action rifles, firearm 10 further may include a bolt handle 30 configured to selectively translate bolt 28. As an example, in an embodiment of firearm 10 in which bolt 28 is manually actuated between the forward and aft position, bolt handle 30 may be fixedly coupled to the bolt and configured to be gripped and actuated by the user. In an embodiment in which firearm 10 is a semi-automatic firearm, bolt handle 30 additionally or alternatively may be referred to as a charging handle 30, and/or may be configured to be selectively translated by a user primarily and/or exclusively in the aft direction. Additionally or alternatively, firearm 10 may include a lever configured to be selectively actuated to load an ammunition cartridge into barrel 48.

As used herein, positional terms such as "left," "right," "forward," "rear," "fore," "aft," "upper," "lower," and the like generally are recited with respect to a direction in which firearm 10 is aimed. For example, barrel 48 may be described as being forward of receiver 20, and a right side of firearm 10 may describe a side of firearm 10 that faces the user when firearm 10 is aimed to the right of the user.

Firearm 10 still further may include a safety lever 36 configured to be selectively actuated by the user to transition the firearm between an operative mode, in which the firearm may be fired, and a safety mode, in which the firearm is restricted from being fired. Safety lever 36, when present, may be positioned on first side 22 and/or on second side 24 of receiver 20. Firearm 10 also may include a trigger guard 44 extending at least partially around trigger 42 and configured to block the trigger from being inadvertently struck and/or actuated.

Firearm 10 may be configured to be utilized in conjunction with one or more firearm accessories 50 operatively coupled to the firearm. As examples, and as illustrated in FIG. 1, examples of firearm accessory 50 include a light coupled to a lower side of barrel 48, a sight extending from an upper side of the barrel, a scope extending from an upper side of firearm 10, and a chamber flag 52 configured to be selectively inserted into the barrel via ejection port 26. More specifically, chamber flag 52 may include an elongate element configured to be inserted into barrel 48 such that bolt 28 is restricted from being translated to the forward position, thereby preventing firearm 10 from being fired. Additionally or alternatively, firearm cover 100 may incorporate chamber flag 52 as a component of firearm cover 100, including standard or traditional features (e.g., shapes and colors) of chamber flags 52, such that the presence of chamber flag 52 is readily apparent to knowledgeable personnel when viewing firearm 10 with firearm cover 100 operatively installed on firearm 10. As another example, firearm 10 may include a stock 54 at a rear end of the firearm configured to be supported by the user's body, such as the user's shoulder, such as to steady the firearm before firing.

As illustrated in FIG. 1, firearm cover 100 may be operatively installed on firearm 10 to restrict and/or prevent firing of the firearm. With reference to FIGS. 1-2, firearm cover 100 includes a body 110 defining a partially enclosed region 114 sized and shaped to operatively receive at least a portion of receiver 20. As used herein, receiver 20 may be said to be operatively received in partially enclosed region 114 when the receiver is fully received in the partially enclosed region and/or is received in its intended position within the partially enclosed region, such as a position in which firearm 10 is disabled and/or restricted from being fired by firearm cover 100.

Body 110 may include an outer surface 112 positioned opposite partially enclosed region 114. Body 110 may be shaped to conform to an outer surface of receiver 20 when the receiver is operatively received in partially enclosed region 114. For example, firearm cover 100 may be configured to be utilized with a given style and/or model of firearm 10, and body 110 may include at least one firearm conforming feature shaped to receive and/or conform to a feature and/or portion of receiver 20 that characterizes the given style or model of firearm. As more specific examples, firearm cover 100 may be configured to be utilized with a firearm 10 in the form of one or more of an AR-pattern rifle, a magazine-fed rifle, a magazine-fed semi-automatic rifle, an AK-pattern rifle, a semi-automatic rifle, an automatic rifle, a long rifle, a hunting rifle, a bolt action rifle, a lever action rifle, a shotgun, a pump-action shotgun, a semi-automatic shotgun, a black powder rifle, and/or a muzzle-loader rifle. However, it is additionally within the scope of the present disclosure that firearm cover 100 be utilized in conjunction with any appropriate firearm 10.

Body 110 may be configured to only partially enclose receiver 20 when the receiver is operatively received in partially enclosed region 114. As examples, firearm cover 100 and/or body 110 may enclose at least 25%, at least 40%, at least 60%, at least 80%, at most 95%, at most 90%, at most 85%, at most 70%, and/or at most 50%, or in some examples 100%, of receiver 20 when the receiver is operatively received in partially enclosed region 114. Additionally or alternatively, in some examples, firearm cover 100 and/or body 110 may not extend over barrel 48 and/or may not extend over stock 54 when the receiver is operatively received in partially enclosed region 114; however, in other examples, firearm cover 100 and/or body 110 may extend over barrel 48 and/or may extend over stock 54 when the receiver is operatively received in partially enclosed region 114. Additionally or alternatively, firearm cover 100 may be free of an external structure for operatively retaining firearm 10 on an article of clothing, such as a belt clip or a harness attachment point.

Firearm cover 100 is configured to transition between a clamped conformation (as illustrated in solid lines in FIG. 2), in which body 110 is retained on receiver 20, and an open conformation (as illustrated in dash-dot-dot lines in FIG. 2), in which the body is configured to be selectively placed over and removed from the receiver. Body 110 generally is biased toward the clamped conformation, such as to prevent firearm cover 100 from being inadvertently removed from receiver 20. Body 110 includes a first side wall 120 with a first lip 122 and a second side wall 124 opposite the first side wall and with a second lip 126. First lip 122 and second lip 126 are spaced further apart when body 110 is in the open conformation relative to when the body is in the clamped conformation. First side wall 120 is configured to at least partially cover first receiver side 22 and second side wall 124 is configured to at least partially cover second receiver side 24 when receiver 20 is operatively received in partially enclosed region 114.

First lip 122 and second lip 126 define a longitudinal opening 128 to partially enclosed region 114 between the first lip and the second lip. As used herein, a longitudinal direction is intended to indicate a direction that is generally aligned with a length of firearm 10, such as a direction that is parallel, or at least substantially parallel, to a length of barrel 48. First side wall 120 and second side wall 124 define a forward opening 130 and a rear opening 132 to partially enclosed region 114, such that firearm 10 extends through each of the forward opening and the rear opening when receiver 20 is operatively received in the partially enclosed region. Body 110 further includes a connecting region 134 extending between and connecting first side wall 120 and second side wall 124. Body 110 additionally may include a removal tab 182 projecting from connecting region 134 and configured to be gripped by the user to facilitate removal of firearm cover 100 from firearm 10 and/or installation of the firearm cover onto the firearm.

Body 110 may be constructed of any appropriate material. For example, body 110 may be constructed of a semi-rigid, flexible material, such as a material that has an internal bias that biases the body toward the clamped conformation. As more specific examples, body 110 may include, consist of, and/or consist essentially of a plastic, a thermoplastic, a thermoset plastic, and/or an acrylic-polyvinyl chloride such as sold under the KYDEX™ brand, but other materials also may be used. Additionally or alternatively, body 110 may include a soft inner liner 116 facing partially enclosed region 114, which may be configured and/or selected to resist damaging, scratching, and/or marring receiver 20. Soft inner liner 116 may be constructed of any appropriate material, such as a fabric material, a felt material, and/or leather.

Body 110 may be biased toward the clamped conformation in any appropriate manner. For example, body 110 may be integrally biased toward the clamped conformation, and/or may be described as being, defining, and/or including a spring clip. Additionally or alternatively, body 110 may be internally biased toward the clamped conformation, and/or may include a spring 136 operatively coupled to the body that biases the body toward the clamped conformation. Additionally or alternatively, body 110 may include a hinge 138 configured to facilitate transition of the body between the open conformation and the clamped conformation. When present, hinge 138 may be operatively coupled to connecting region 134, or may be a component of connecting region 134.

Firearm cover 100 may be configured to be installed on firearm 10 in any appropriate manner. For example, body 110 may be configured to be operatively placed over and removed from receiver 20 from a lower side of the receiver, and/or longitudinal opening 128 may be positioned adjacent an upper side of the receiver when the receiver is operatively received in partially enclosed region 114. Additionally or alternatively, body 110 may be configured to be operatively placed over and removed from receiver 20 from the upper side of the receiver, and/or longitudinal opening 128 may be positioned adjacent the lower side of the receiver when the receiver is operatively received in partially enclosed region 114.

In some examples, receiver 20 may be positioned within longitudinal opening 128 when the receiver is operatively received in partially enclosed region 114. In such a configuration, first lip 122 and/or second lip 126 may engage and/or apply a retention force to receiver 20 when the receiver is operatively received in partially enclosed region 114. Alternatively, in other examples, longitudinal opening 128 and/or at least one of first lip 122 and second lip 126 may extend adjacent to receiver 20 when the receiver is operatively received in the partially enclosed region. Additionally or alternatively, first lip 122 may extend toward partially enclosed region 114 relative to an adjacent portion of first side wall 120, and/or second lip 126 may extend toward the partially enclosed region relative to an adjacent portion of second side wall 124, such as schematically and optionally illustrated in FIG. 2. In such a configuration, first lip 122 and/or second lip 126 may be described as being inwardly directed lips.

With continued reference to FIGS. 1-2, firearm cover 100 may include an upper retainer 140 operatively coupled to one of first side wall 120 and second side wall 124 and configured to be selectively extended across longitudinal opening 128 and temporarily coupled to the other of the first side wall and the second side wall, such as to restrict removal of receiver 20 from partially enclosed region 114 through the longitudinal opening when the receiver is operatively received in the partially enclosed region. Additionally or alternatively, firearm cover 100 may include a front retainer 144 operatively coupled to one of first side wall 120 and second side wall 124 and configured to be selectively extended across forward opening 130 and temporarily coupled to the other of the first side wall and the second side wall, such as to restrict removal of receiver 20 from partially enclosed region 114 through the forward opening when the receiver is operatively received in the partially enclosed region. Additionally or alternatively, firearm cover may include a rear retainer 142 operatively coupled to one of first side wall 120 and second side wall 124 and configured to be selectively extended across rear opening 132 and temporarily coupled to the other of the first side wall and the second side wall, such as to restrict removal of receiver 20 from partially enclosed region 114 through the rear opening when the receiver is operatively received in the partially enclosed region. Upper retainer 140, front retainer 144, and/or rear retainer 142, when present, may include and/or be any appropriate structure, such as a strap, an elastic strap, a clip, and/or a protrusion. Additionally, upper retainer 140, front retainer 144, and/or rear retainer 142, when present, may be operatively and selectively coupled to first side wall 120 and/or second side wall 124 by any appropriate mechanism, such as a hook-and-loop fastener, a button fastener, a magnetic fastener, a snap fastener, and/or a clip fastener.

Firearm cover 100 generally is configured to prevent and/or restrict firearm 10 from being fired when receiver 20 is operatively received in partially enclosed region 114. To accomplish this, firearm cover 100 may include at least one disabling structure 150 configured to physically disable firearm 10 so as to prevent it from being fired when receiver 20 is operatively received in partially enclosed region 114. Disabling structure 150 may be defined by body 110 of firearm cover 100, may be operatively coupled to the body, and/or may extend from the body. Additionally, firearm cover 100 may be configured to provide a visual indication of the presence and/or nature of the at least one disabling structure 150. For example, outer surface 112 of body 110 may include highly conspicuous indicia and/or have a highly conspicuous color, which may represent or otherwise indicate the at least one disabling structure 150. As more specific examples, outer surface 112 may have a bright color, a fluorescent color, a neon color, a reflective color, and/or a color and/or indicia generally understood within the sport of firearm shooting to indicate a specific state of safety and/or inoperability of firearm 10.

As a first example of disabling structure 150, and as schematically illustrated in FIGS. 1-2, the at least one disabling structure 150 may include a bolt restriction structure 152 positioned to extend within ejection port 26 of firearm 10 when bolt 28 of the firearm is open and when receiver 20 is operatively received in partially enclosed region 114, thereby preventing closure of the bolt and firing of the firearm. When present, bolt restriction structure 152 may extend from first side wall 120 or second side wall 124 and into partially enclosed region 114. Additionally or alternatively, bolt restriction structure 152 may include chamber flag 52 and/or be configured to operatively and selectively receive chamber flag 52. In some examples, the bolt restriction structure may extend over, or cover, an entirety of ejection port 26. In other examples, the bolt restriction structure may extend over, or cover, only a portion of ejection port 26, such as a rear, or aft, region of the ejection port. In such examples, the bolt restriction structure may prevent the bolt from closing and thus the firing of the firearm, but also a user may still visually see within the ejection port, and in some instances, the firing chamber, and thus be able to see if a cartridge is in the firing chamber. Additionally or alternatively, such examples may permit for a chamber flag 52 to be operatively installed into the firing chamber and ejection port even when the firearm cover is operatively installed on the firearm.

As a second example of disabling structure 150, and as schematically illustrated in FIG. 1, in an embodiment of firearm cover 100 configured to be installed on a firearm 10 that includes charging handle 30, the at least one disabling structure 150 additionally or alternatively may include a charging handle restriction structure 154 positioned to restrict movement of the charging handle when receiver 20 is operatively received in partially enclosed region 114. In an embodiment of firearm cover 100 that includes charging handle restriction structure 154, and when receiver 20 is operatively received in partially enclosed region 114, the charging handle restriction structure may be positioned to restrict rearward movement of the charging handle when the charging handle is in a forward position, and/or may be positioned to restrict forward movement of the charging handle when the charging handle is in a rearward position.

As a third example of disabling structure 150, and as schematically illustrated in FIG. 1, in an embodiment of firearm cover 100 configured to be installed on a firearm 10 in the form of a bolt action rifle that includes bolt handle 30, the at least one disabling structure 150 additionally or alternatively may include a bolt handle restriction structure 156 positioned to restrict motion of the bolt handle when receiver 20 is operatively received in partially enclosed region 114. In an embodiment of firearm cover 100 that includes bolt handle restriction structure 156, and when receiver 20 is operatively received in partially enclosed region 114, the bolt handle restriction structure may be positioned to restrict closure of bolt 28 of firearm 10 when the bolt is open, thereby preventing the firearm from being fired. Additionally or alternatively, bolt handle restriction structure 156 may be positioned to restrict opening of bolt 28 when the bolt is closed, such as to prevent the user from loading an ammunition cartridge into firearm 10.

As a fourth example of disabling structure 150, and as schematically illustrated in FIG. 2, in an embodiment of firearm cover 100 configured to be installed on a firearm 10 that includes an external hammer, the at least one disabling structure 150 additionally or alternatively may include a hammer restriction structure 158 positioned to restrict motion of the hammer when receiver 20 is operatively received in partially enclosed region 114. In an embodiment of firearm cover 100 that includes hammer restriction structure 158, and when receiver 20 is operatively received in partially enclosed region 114, the hammer restriction structure may be positioned to restrict movement of the external hammer from a cocked position toward a decocked position, may be positioned to restrict movement of the external hammer from the decocked position toward the cocked position, and/or may be positioned to restrict movement of the external hammer from a half-cocked position toward both the cocked position and the decocked position. Thus, hammer restriction structure 158 may prevent firearm 10 from being fired by preventing the external hammer from translating as necessary to complete a firing process. As a more specific example, hammer restriction structure 158 may include and/or be a hammer notch 118 defined by first side wall 120 (and/or first lip 122 thereof) and/or by second side wall 124 (and/or second lip 126 thereof) and positioned to receive the external hammer when receiver 20 is operatively received in partially enclosed region 114. Additionally or alternatively, hammer restriction structure 158 may include and/or be a structure that physically covers the external hammer of a firearm, both restricting access to the external hammer and restricting movement of the external hammer to prevent firearm 10 from being fired when receiver 20 is operatively received in partially enclosed region 114.

As a fifth example of a disabling structure 150, in an embodiment of firearm cover 100 configured to be installed on a lever action rifle, the disabling structure 150 may be configured to extend between the lever and the adjacent body of the lever action rifle when receiver 20 is operatively received in partially enclosed region 114, such that the disabling structure prevents a reloading process from completing and thus prevents the firing mechanism of the lever action rifle from being in an operative condition for firing.

Firearm cover 100 additionally or alternatively may include at least one restricting structure 160 configured to physically restrict firearm 10 from being fired when receiver 20 is operatively received in partially enclosed region 114. In particular, whereas disabling structure 150 is configured to physically disable firearm 10 from being fired, restricting structure 160 instead is configured to inhibit the firearm from being fired even if the firearm is physically capable of being fired. Stated differently, disabling structure 150 may refer to a structure that interrupts and/or inhibits a firing mechanism of firearm 10 from reaching an operable configuration, whereas restricting structure 160 may refer to a structure that inhibits the firing mechanism from being activated even if the firing mechanism is otherwise operational. Restricting structure 160 may be defined by body 110 of firearm cover 100, may be operatively coupled to the body, and/or may extend from the body.

As a first example of restricting structure 160, and as schematically illustrated in FIG. 1, the at least one restricting structure 160 may include a safety restriction structure 162 positioned to restrict movement of safety lever 36 of firearm 10 when receiver 20 is operatively received in partially enclosed region 114. Safety restriction structure 162 may be positioned on first side wall 120, on second side wall 124, or on another portion of firearm cover 100. Additionally or alternatively, safety restriction structure 162 may be a first safety structure 162 positioned on first side wall 120, and body 110 also may include a second safety restriction structure 164 positioned on second side wall 124. Such a configuration may be beneficial, for example, when utilizing firearm cover 100 with a firearm 10 that includes a safety lever on each of first body side 22 and second body side 24, such as may be present on an ambidextrous firearm. Additionally or alternatively, in some examples, safety restriction structure 162 may be configured to operate, or otherwise move, safety lever 36 when firearm cover 100 is operatively placed on firearm 10, such as with safety restriction structure 162 engaging and moving safety lever 36 as firearm cover 100 is operatively installed on receiver 20.

As a second example of restricting structure 160, and as schematically illustrated in FIGS. 1-2, the at least one restricting structure 160 may include a trigger cover 166 configured to cover at least trigger 42 and optionally trigger guard 44 of firearm 10, such as to prevent access to the trigger when receiver 20 is operatively received in partially enclosed region 114. As an example, trigger cover 166 may include and/or be a region of each of first side wall 120 and second side wall 124 configured to cover trigger 42 and/or trigger guard 44, and/or may be indented toward partially enclosed region 114.

As a third example of restricting structure 160, and as schematically illustrated in FIGS. 1-2, the at least one restricting structure 160 may include a magazine well structure 168 positioned to extend within magazine well 40 of firearm 10 when receiver 20 is operatively received in partially enclosed region 114. Magazine well structure 168 thus may prevent insertion of a magazine into magazine well 40 when receiver 20 is operatively received in partially enclosed region 114. Similarly, magazine well structure 168 and/or firearm cover 100 that includes the magazine well structure may be configured such that receiver 20 cannot be operatively received in partially enclosed region 114 if a magazine is positioned within magazine well 40. Magazine well structure 168 may include and/or be any appropriate structure configured to extend into magazine well 40. For example, and as illustrated in FIGS. 1-2 and 4-9, magazine well structure 168 may be a structure that extends from connecting region 134 into partially enclosed region 114. However, this is not required, and it is within the scope of the present disclosure that magazine well structure 168 may extend into partially enclosed region 114 from any appropriate component of body 110, such as from first side wall 120 and/or from second side wall 124, such as depending on the configuration of firearm 10.

As a fourth example of restricting structure 160, in an embodiment of firearm cover 100 configured to be installed on a lever action rifle, first side wall 120 and/or second side wall 124 may be configured to cover a lever of a lever action rifle when receiver 20 is operatively received in partially enclosed region 114. In such a configuration, firearm cover 100 may restrict a firearm 10 from being fired by preventing the lever from translating as necessary to complete a reloading process.

Figure 3:
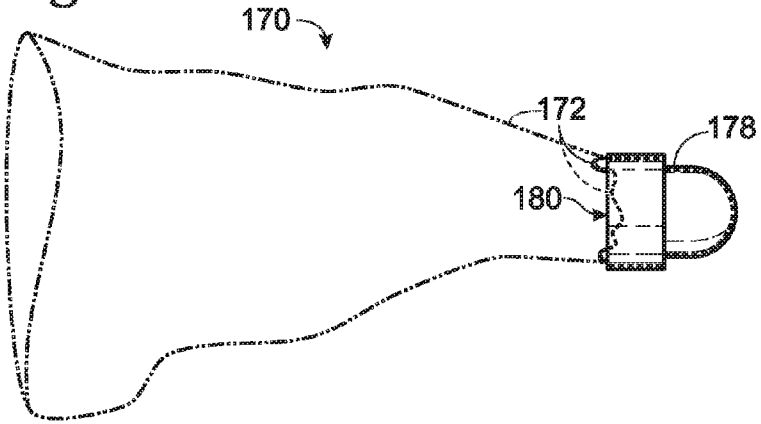
FIG. 3 is a right side elevation view representing a barrel sheath of a firearm cover.

With continued reference to FIG. 1, firearm cover 100 additionally may include a barrel sheath 170 with an elongate flexible portion 172 operatively coupled to body 110 and a muzzle cup 178 operatively coupled to the elongate flexible portion. Muzzle cup 178 may define a muzzle volume 180 configured to operatively receive muzzle 46 of firearm 10. Elongate flexible portion 172 may be sized to extend forward of body 110 along barrel 48 of firearm 10 and to at least partially enclose the barrel when receiver 20 is operatively received in partially enclosed region 114 and when muzzle 46 is operatively received in muzzle volume 180. Barrel sheath 170 may be configured to be selectively uncoupled from and recoupled to body 110. For example, barrel sheath 170 and/or body 110 may include a releasable fastener, examples of which include a hook-and-loop fastener, a button fastener, a snap fastener, and a zipper fastener. Additionally or alternatively, and as illustrated in FIG. 3, barrel sheath 170 may be configured such that elongate flexible portion 172 may be at least partially received in, and optionally fully received in, muzzle cup 178 and/or muzzle volume 180 thereof, such as for convenient storage of the barrel sheath when uncoupled from body 110.

As schematically illustrated in FIG. 1, elongate flexible portion 172 of barrel sheath 170 may define an upper slit 174 that extends at least partially along an upper side of the elongate flexible portion and/or a lower slit 176 that extends at least partially along a lower side of the elongate flexible portion. Upper slit 174 and/or lower slit 176 may be sized to permit firearm accessory 50 to extend therethrough when the firearm accessory is coupled to firearm 10. Elongate flexible portion 172 may be constructed of any appropriate material, such as a stretchy material, a fabric material, and/or an elastic material. Additionally or alternatively, elongate flexible portion 172 may be constructed of a material configured and/or selected to resist damaging, scratching, and/or marring a surface of firearm 10 and/or barrel 48. Muzzle cup 178 also may be constructed of any appropriate material, such as a rigid or semi-rigid material, as well as a heat-resistant material, such as one that will not melt, or otherwise deteriorate or become damaged when in contact with a muzzle of a firearm after recent use of the firearm. In some examples, barrel sheath 170 and/or muzzle cup 178 may be configured to provide a visual indication of the presence and/or nature of firearm cover 100. For example, elongate flexible portion 172 and/or muzzle cup 178 may include highly conspicuous indicia and/or have a highly conspicuous color, which may represent or otherwise indicate the presence and/or the nature of firearm cover 100. As more specific examples, elongate flexible portion 172 and/or muzzle cup 178 may have a bright color, a fluorescent color, a neon color, a reflective color, and/or a color and/or indicia generally understood within the sport of firearm shooting to indicate a specific state of safety and/or inoperability of firearm 10.

Turning now to FIGS. 4-13, illustrative, non-exclusive examples of firearm covers 100 are illustrated. Where appropriate, the reference numerals from the schematic illustrations of FIGS. 1-2 are used to designate corresponding parts of firearm covers 100 and firearms 10 in FIGS. 4-13; however, the examples of FIGS. 4-13 are non-exclusive and do not limit firearm covers 100 or firearms 10 to the illustrated embodiments of FIGS. 4-13. That is, firearm covers 100 and firearms 10 are not limited to the specific embodiments illustrated in FIGS. 4-13, and firearm covers 100 and/or firearms 10 may incorporate any number of the various aspects, configurations, characteristics, properties, etc. that are illustrated in and discussed with reference to the schematic representations of FIGS. 1-3 and/or the embodiments of FIGS. 4-13, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to FIGS. 4-13; however, it is within the scope of the present disclosure that the previously discussed features, variants, etc. may be utilized with any appropriate firearm cover 100 and/or firearm 10.

Figure 4:
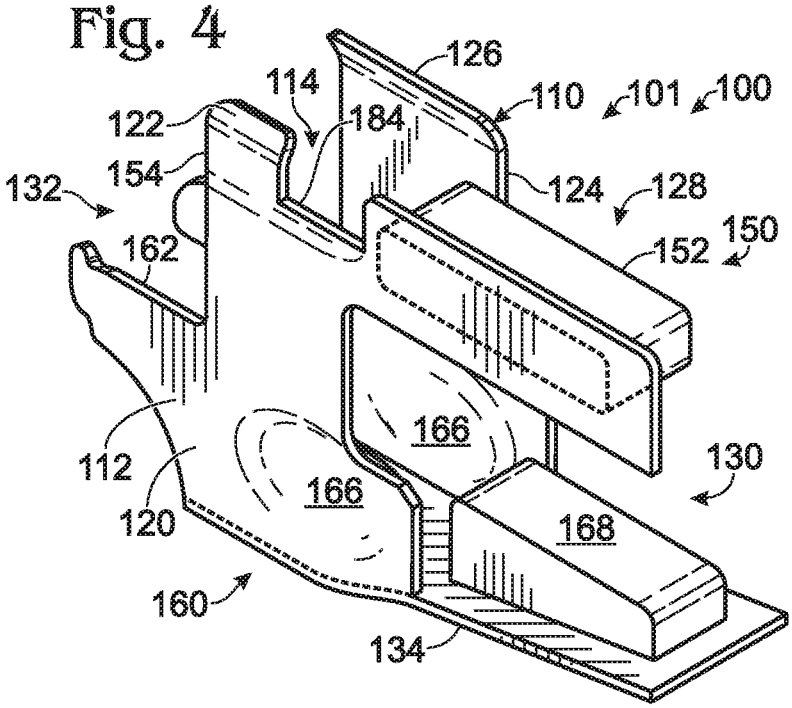
FIG. 4 is a front right perspective view representing a firearm cover configured to be installed on a magazine-fed semi-automatic rifle.
Figure 5:
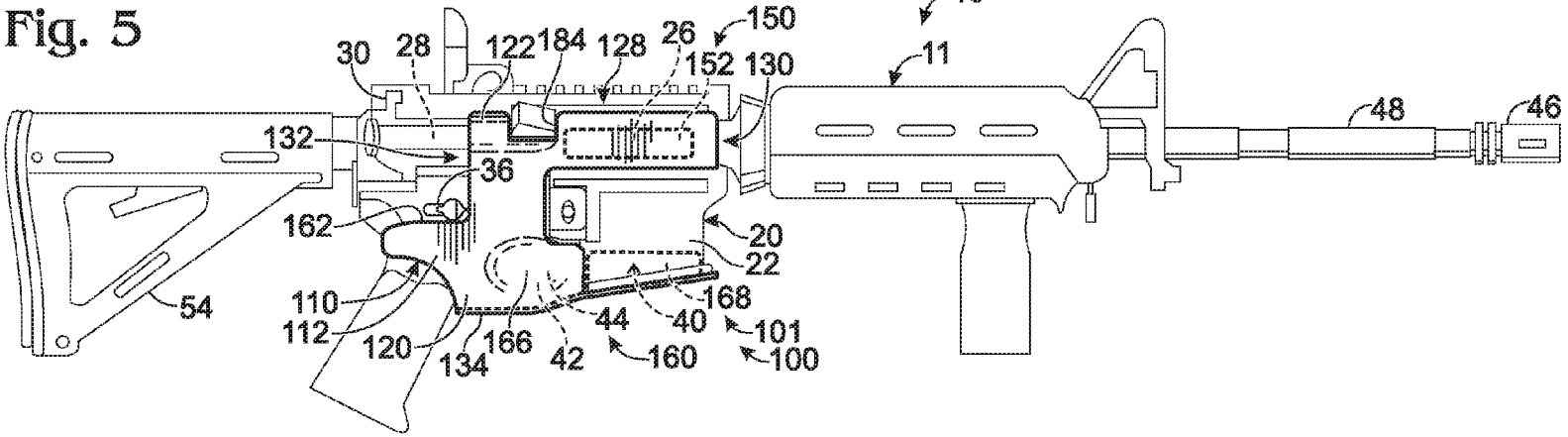
FIG. 5 is a right side elevation view representing the firearm cover of FIG. 4 installed on a magazine-fed semi-automatic rifle.
Figure 6:
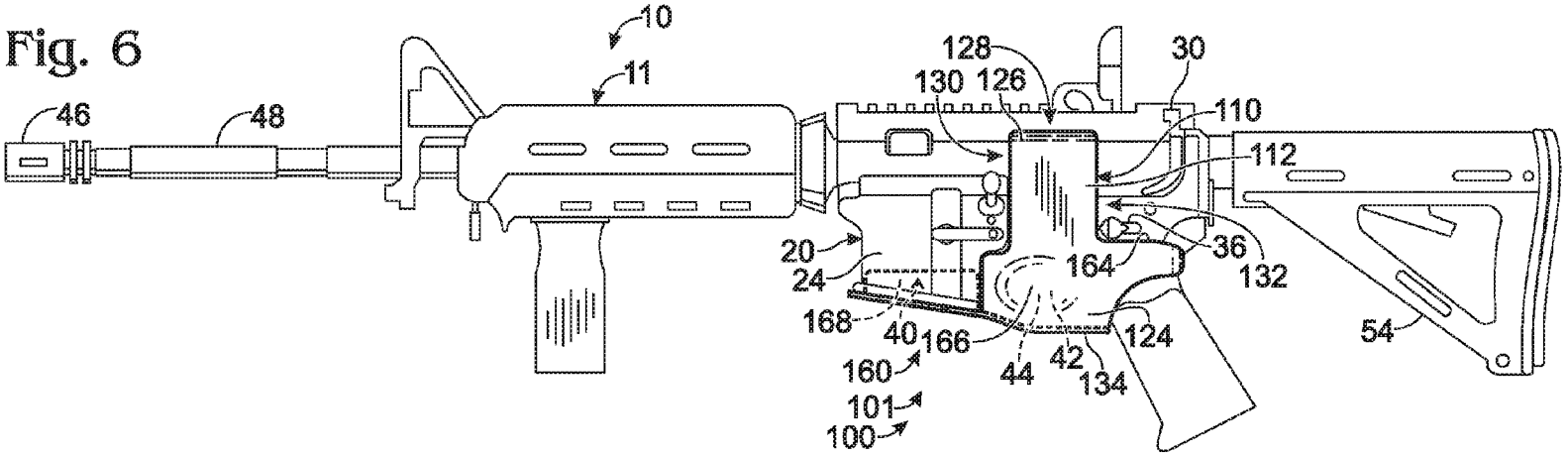
FIG. 6 is a left side elevation view representing the firearm cover of FIGS. 4-5 installed on the magazine-fed semi-automatic rifle.

FIG. 4 provides an illustrative, non-exclusive example of firearm cover 100 in the form of a magazine-fed semi-automatic rifle cover 101 configured to be utilized in conjunction with firearm 10 in the form of a magazine-fed semi-automatic rifle 11, and FIGS. 5-6 illustrate the magazine-fed semi-automatic rifle cover installed on the magazine-fed semi-automatic rifle. As illustrated in FIGS. 4-6, magazine-fed semi-automatic rifle cover 101 includes disabling structure 150 in the form of bolt restriction structure 152 extending from first side wall 120, and includes restricting structure 160 in the form of first safety restriction structure 162 on the first side wall, second safety restriction structure 164 on second side wall 124, trigger cover 166 on each of the first side wall and the second side wall, and magazine well structure 168 extending from connecting region 134. As further illustrated in FIGS. 4-6, magazine-fed semi-automatic rifle cover 101 additionally includes a firearm conforming feature 184 in the form of a notch partially defined by first lip 122 configured to conform to a shell deflector positioned adjacent to ejection port 26 of magazine-fed semi-automatic rifle 11. Thus, when receiver 20 of magazine-fed semi-automatic rifle 11 is operatively received in partially enclosed region 114 of magazine-fed semi-automatic rifle cover 101, bolt restriction structure 152 prevents bolt 28 from closing, first safety restriction structure 162 and/or second safety restriction structure 164 restricts the magazine-fed semi-automatic rifle from being transitioned to a firing mode, trigger cover 166 restricts trigger 42 from being actuated, and magazine well structure 168 prevents a magazine of ammunition from being inserted into magazine well 40. More specifically, safety restriction structure 162 of magazine-fed semi-automatic rifle cover 101 includes an elongate portion on one of first side wall 120 and second side wall 124 that extends rearward from an adjacent portion of the first side wall or the second side wall.

With reference to FIGS. 4-6, magazine-fed semi-automatic rifle cover 101 additionally or alternatively may be described in terms of a shape of body 110 thereof. Specifically, connecting region 134 may be described as extending forward of each of first side wall 120 and second side wall 124, first safety restriction structure 162 may be described as extending rearward of first side wall 120, and second safety restriction structure 164 may be described as extending rearward of second side wall 124. Additionally, bolt restriction structure 152 may be described as extending from a portion of first side wall 120 that extends forward of a remainder of the first side wall, and/or the first side wall may be described as having a cutout partially defined by the portion of the first side wall that extends forward of the remainder of the first side wall.

Figure 7:
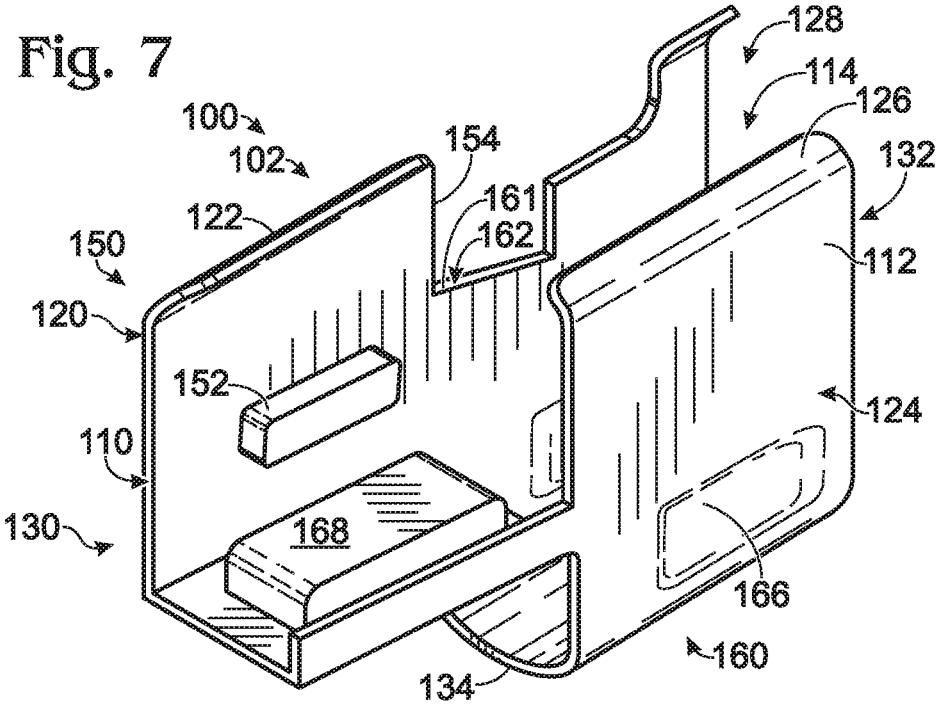
FIG. 7 is a front left perspective view representing a firearm cover configured to be installed on an AK-pattern rifle.
Figure 8:
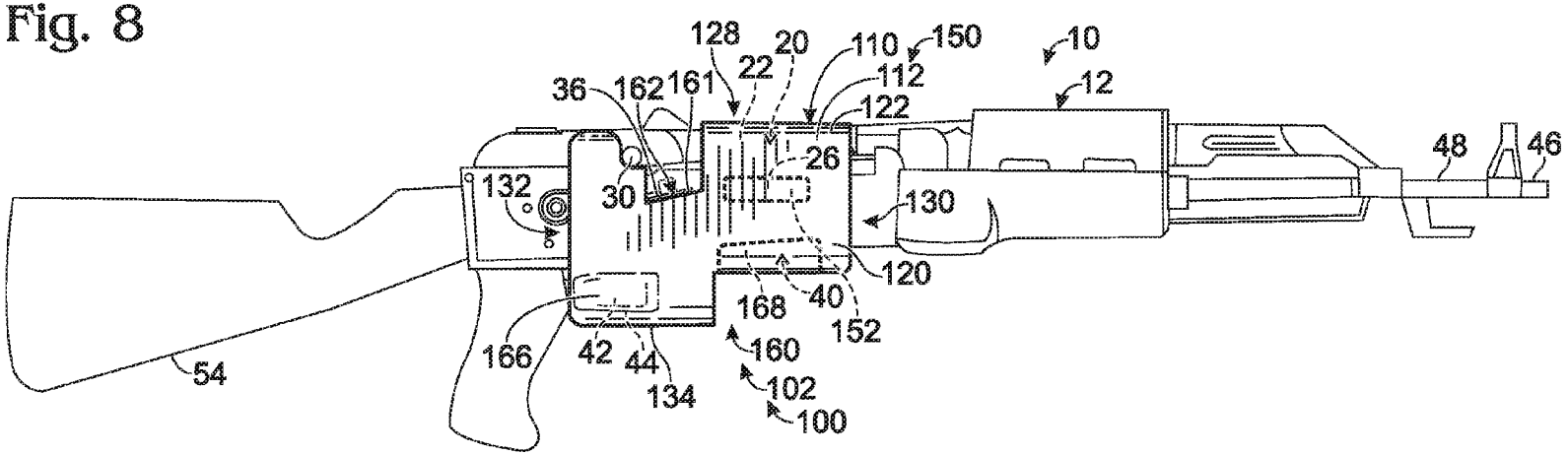
FIG. 8 is a right side elevation view representing the firearm cover of FIG. 7 installed on an AK-pattern rifle.
Figure 9:
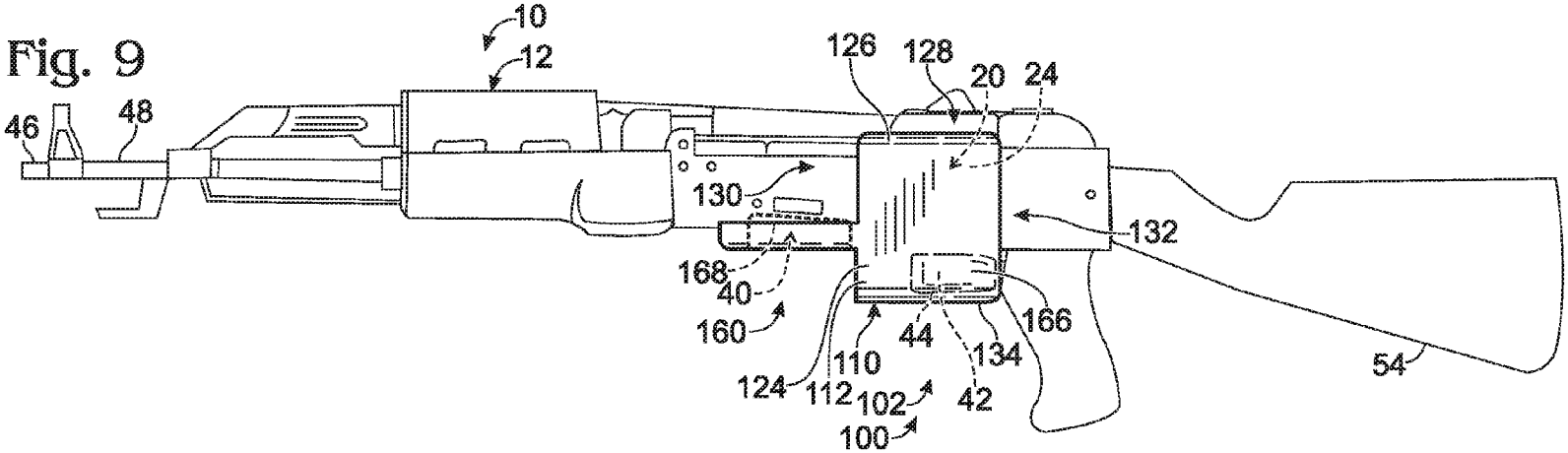
FIG. 9 is a left side elevation view representing the firearm cover of FIGS. 7-8 installed on the AK-pattern rifle.

FIG. 7 provides an illustrative, non-exclusive example of firearm cover 100 in the form of an AK-pattern cover 102 configured to be utilized in conjunction with firearm 10 in the form of an AK-pattern rifle 12 (e.g., an AK-47 or other AK-pattern rifle), and FIGS. 8-9 illustrate the AK-pattern cover installed on an AK-pattern rifle 12. As illustrated in FIGS. 7-9, AK-pattern cover 102 includes disabling structure 150 in the form of bolt restriction structure 152 extending from first side wall 120, and includes restricting structure 160 in the form of safety restriction structure 162 on the first side wall, trigger cover 166 on each of the first side wall and second side wall 124, and magazine well structure 168 extending from connecting region 134. Thus, when receiver 20 of AK-pattern rifle 12 is operatively received in partially enclosed region 114 of AK-pattern cover 102, bolt restriction structure 152 prevents the rifle's bolt from closing, safety restriction structure 162 restricts the AK-pattern rifle from being transitioned to a firing mode, trigger cover 166 restricts trigger 42 from being actuated, and magazine well structure 168 prevents a magazine of ammunition from being inserted into magazine well 40. More specifically, safety restriction structure 162 of AK-pattern cover 102 includes an elongate portion of first side wall 120 positioned such that safety lever 36 extends through a safety lever notch 161 when receiver 20 of AK-pattern rifle 12 is operatively received in partially enclosed region 114 of AK-pattern cover 102.

With reference to FIGS. 7-9, AK-pattern cover 102 additionally or alternatively may be described in terms of a shape of body 110 thereof. Specifically, connecting region 134 may be described as being coextensive with second side wall 124 in the fore-aft direction, and first side wall 120 may be described as extending forward of the connecting region and the second side wall. Additionally or alternatively, magazine well structure 168 may be described as extending from a forward portion of connecting region 134 that is positioned vertically above a rearward portion of the connection region, and bolt restriction structure 152 may be described as projecting from a region of first side wall 120 that is coextensive with the forward region of the connecting region and the is forward of the rearward portion of the connection region.

Figure 10:
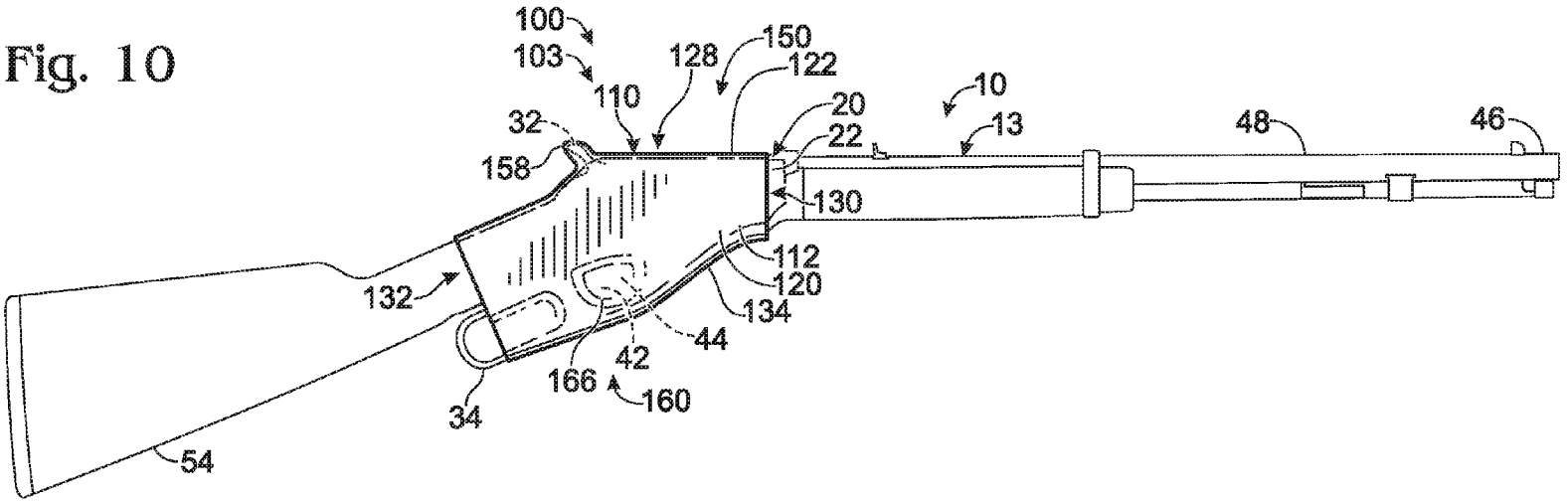
FIG. 10 is a right side elevation view representing a firearm cover installed on a lever action rifle.

FIG. 10 provides an illustrative, non-exclusive example of firearm cover 100 in the form of a lever action rifle cover 103 installed on firearm 10 in the form of a lever action rifle 13 that includes a lever 34. As illustrated in FIG. 10, lever action rifle cover 103 includes disabling structure 150 in the form of hammer restriction structure 158 defined by the first side wall, and includes restricting structure 160 in the form of trigger cover 166 on each of the first side wall and the second side wall. Thus, when receiver 20 of lever action rifle 13 is operatively received in the partially enclosed region of lever action rifle cover 103, hammer restriction structure 158 restricts an external hammer 32 of lever action rifle 13 from being cocked or decocked, and trigger cover 166 restricts trigger 42 from being actuated. Additionally, and as illustrated in FIG. 10, lever action rifle cover 103 is configured to restrict lever 34 from being actuated. More specifically, lever action rifle cover 103 may be described as engaging lever 34 so as to physically impede the lever from pivoting in a downward direction, which in turn may prevent a round from being chambered.

Figure 11:
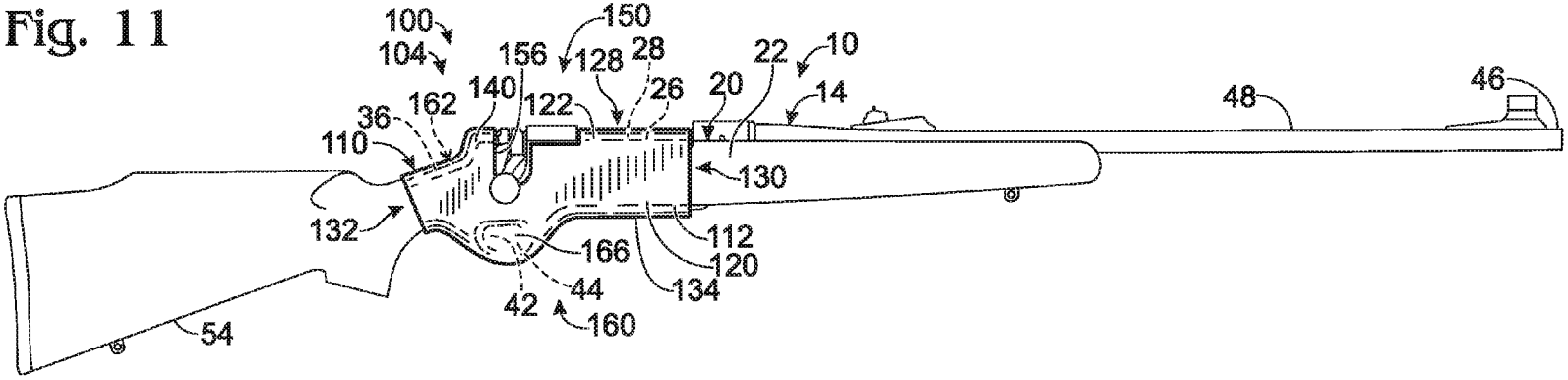
FIG. 11 is a right side elevation view representing a firearm cover installed on a bolt action rifle.

FIG. 11 provides an illustrative, non-exclusive example of firearm cover 100 in the form of a bolt action rifle cover 104 installed on firearm 10 in the form of a bolt action rifle 14. As illustrated in FIG. 11, bolt action rifle cover 104 includes disabling structure 150 in the form of bolt handle restriction structure 156 defined by the first side wall, and includes restricting structure 160 in the form of trigger cover 166 on each of the first side wall and the second side wall. Thus, when receiver 20 of bolt action rifle 14 is operatively received in the partially enclosed region of bolt action rifle 104, bolt handle restriction structure 156 prevents the bolt from transitioning between an open position and a closed position, and trigger cover 166 restricts trigger 42 from being actuated. Moreover, bolt action rifle cover 104 when operatively installed on bolt action rifle 14 operatively covers safety 36, which on some bolt action rifles is on the upper side of the stock rearward of the bolt; however, a safety 36 may be positioned in various positions on differently configured bolt action rifles and regardless of where a safety is positioned, it is within the scope of the present disclosure that a bolt action rifle cover 104 may operatively cover the safety. Accordingly, one or both of the first sidewall and the second sidewall of the bolt action rifle cover 104 may define a safety restriction structure 162.

Figure 12:
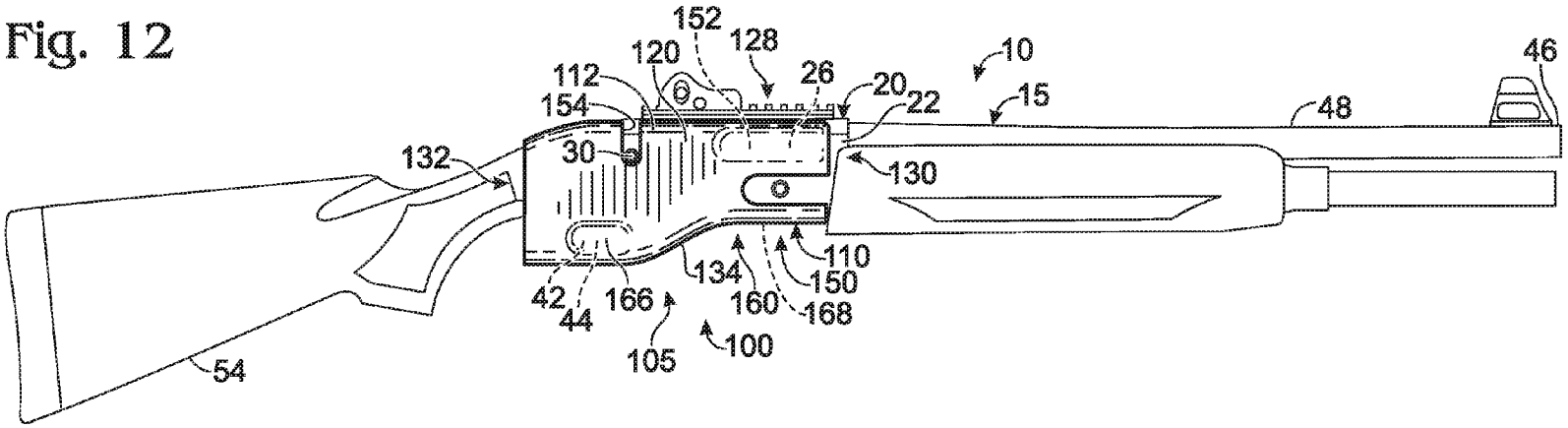
FIG. 12 is a right side elevation view representing a firearm cover installed on a semi-automatic shotgun.

FIG. 12 provides an illustrative, non-exclusive example of firearm cover 100 in the form of a semi-automatic shotgun cover 105 installed on firearm 10 in the form of a semi-automatic shotgun 15. As illustrated in FIG. 12, semi-automatic shotgun cover 105 includes disabling structure 150 in the form of bolt restriction structure 152 extending from first side wall 120 and charging handle restriction structure 154 defined by the first side wall, and includes restricting structure 160 in the form of trigger cover 166 on each of the first side wall and the second side wall. In addition, connecting region 134 of semi-automatic shotgun cover 105 covers the shell port of semi-automatic shotgun 15 and this restricts insertion of shells into the internal magazine of the semi-automatic shotgun. Accordingly, connecting region 134 of semi-automatic shotgun cover 105 may be described as defining magazine well structure 168. Alternatively, semi-automatic shotgun cover 105 may comprise magazine well structure 168 that extends from connecting region 134 into the shell port of semi-automatic shotgun 15 when receiver 20 is operatively received in the partially enclosed region of the semi-automatic shotgun. In addition, one of the first side wall and the second side wall of semi-automatic shotgun cover 105 restricts access to the safety of the semi-automatic shotgun and thus may be described as defining a safety restriction structure 162. Thus, when receiver 20 of semi-automatic shotgun 15 is operatively received in the partially enclosed region of semi-automatic shotgun cover 105, bolt restriction structure 152 prevents the bolt from closing, charging handle restriction structure 154 prevents charging handle 30 from being translated in a rearward direction, trigger cover 166 restricts trigger 42 from being actuated, connecting region 134 restricts access to the shell port, and access to the safety lever is restricted.

Figure 13:
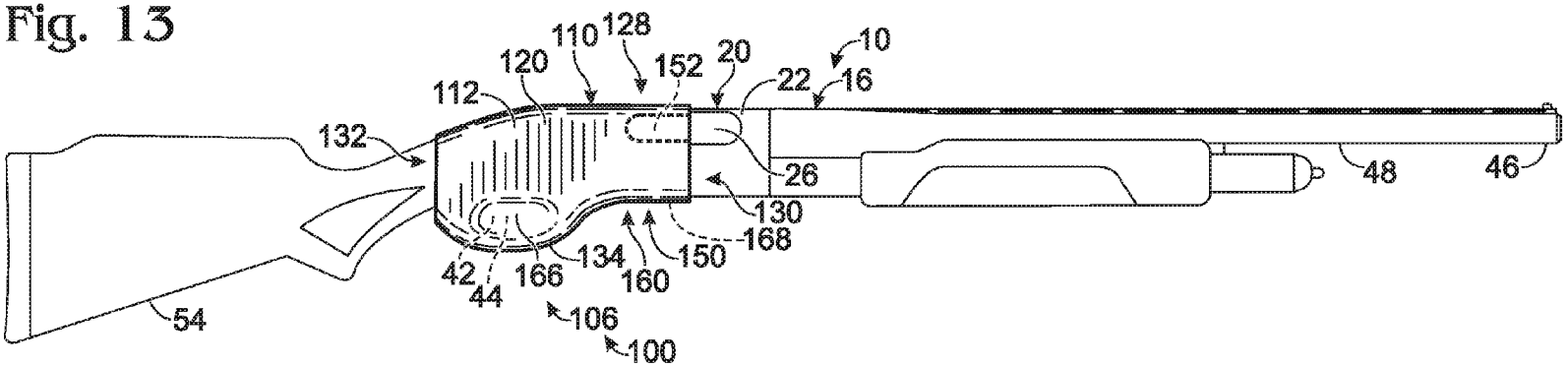
FIG. 13 is a right side elevation view representing a firearm cover installed on a pump-action shotgun.

FIG. 13 provides an illustrative, non-exclusive example of firearm cover 100 in the form of a pump-action shotgun cover 106 installed on firearm 10 in the form of a pump-action shotgun 16. As illustrated in FIG. 13, pump-action shotgun cover 106 includes disabling structure 150 in the form of bolt restriction structure 152 extending from first side wall 120, and includes restricting structure 160 in the form of trigger cover 166 on each of the first side wall and the second side wall. In the illustrated example, the first side wall extends only partially over ejection port 26, and the bolt restriction structure extends only into a rear region of the rejection port. Accordingly, in such an example, a user may still visually see within the ejection port and thus be able to see if a shell is positioned within the firing chamber of the firearm even when the receiver is operatively received in the partially enclosed region of the cover 106. An alternative configuration of a pump-action shotgun cover 106 may fully extend over the ejection port 26. In addition, connecting region 134 of pump-action shotgun cover 106 covers the shell port of pump-action shotgun 16 and this restricts insertion of shells into the internal magazine of the pump-action shotgun. Accordingly, connecting region 134 of pump-action shotgun cover 106 may be described as defining magazine well structure 168. Alternatively, pump-action shotgun cover 106 may comprise magazine well structure 168 that extends from connecting region 134 into the shell port of pump-action shotgun 16 when receiver 20 is operatively received in the partially enclosed region of the pump-action shotgun. In addition, one of the first side wall and the second side wall of pump-action shotgun cover 106 restricts access to the safety of the pump-action shotgun and thus may be described as defining a safety restriction structure 162. Thus, when receiver 20 of pump-action shotgun 16 is operatively received in the partially enclosed region of pump-action shotgun cover 106, bolt restriction structure 152 prevents the bolt from closing, trigger cover 166 restricts trigger 42 from being actuated, connecting region 134 restricts access to the shell port, and access to the safety lever is restricted.

Illustrative, non-exclusive examples of inventive subject matter according to the present disclosure are described in the following enumerated paragraphs:

A. A firearm cover, comprising:

a body defining a partially enclosed region sized and shaped to receive at least a portion of a firearm receiver of a firearm and configured to transition between a clamped conformation and an open conformation, wherein in the clamped conformation, the body is retained on the firearm receiver, wherein in the open conformation, the body is configured to be selectively placed over and removed from the firearm receiver, wherein the body is biased toward the clamped conformation, and wherein the body comprises:

a first side wall having a first lip, wherein the first side wall is configured to at least partially cover a first side of the firearm receiver when the firearm receiver is operatively received in the partially enclosed region;

a second side wall opposite the first side wall and having a second lip, wherein the second side wall is configured to at least partially cover a second side of the firearm receiver when the firearm receiver is received in the partially enclosed region, wherein the first lip and the second lip define a longitudinal opening to the partially enclosed region between the first lip and the second lip, wherein the first lip and the second lip are spaced further apart in the open conformation than in the clamped conformation, wherein the first side wall and the second side wall define a forward opening to the partially enclosed region and a rear opening to the partially enclosed region, and wherein, when the firearm receiver is operatively received in the partially enclosed region, the firearm extends through the forward opening and the rear opening; and a connecting region extending between the first side wall and the second side wall.

A1. The firearm cover of paragraph A, wherein the body is constructed of a semi-rigid, flexible material.

A1.1. The firearm cover of paragraph A1, wherein the semi-rigid flexible material has an internal bias that biases the body toward the clamped conformation.

A1.2. The firearm cover of any of paragraphs A1-A1.1, wherein the semi-rigid flexible material comprises a thermoplastic or an acrylic-polyvinyl chloride.

A2. The firearm cover of any of paragraphs A-A1.2, wherein the body is integrally biased toward the clamped conformation.

A3. The firearm cover of any of paragraphs A-A2, wherein the body is internally biased toward the clamped conformation.

A4. The firearm cover of any of paragraphs A-A3, further comprising:

a spring operatively coupled to the body, wherein the spring biases the body toward the clamped conformation.

A5. The firearm cover of any of paragraphs A-A4, further comprising a hinge operatively coupled to the connecting region of the body, wherein the hinge is configured to facilitate transition of the body between the open conformation and the clamped conformation.

A6. The firearm cover of any of paragraphs A-A4, wherein the connecting region comprises a hinge configured to facilitate transition of the body between the open conformation and the clamped conformation.

A7. The firearm cover of any of paragraphs A-A6, wherein the body is configured to be operatively placed over and removed from the firearm receiver from a lower side of the firearm receiver.

A8. The firearm cover of any of paragraphs A-A7, wherein the longitudinal opening is positioned adjacent an upper side of the firearm receiver when the firearm receiver is operatively received in the partially enclosed region.

A9. The firearm cover of any of paragraphs A-A6, wherein the body is configured to be operatively placed over and removed from the firearm receiver from an upper side of the firearm receiver.

A10. The firearm cover of any of paragraphs A-A6 and A9, wherein the longitudinal opening is positioned adjacent a lower side of the firearm receiver when the firearm receiver is operatively received in the partially enclosed region.

A11. The firearm cover of any of paragraphs A-A10, wherein the firearm receiver is positioned within the longitudinal opening when the firearm receiver is operatively received in the partially enclosed region.

A12. The firearm cover of any of paragraphs A-A10, wherein the longitudinal opening extends adjacent to the firearm receiver when the firearm receiver is operatively received in the partially enclosed region.

A13. The firearm cover of any of paragraphs A-A12, wherein the first lip extends toward the partially enclosed region relative to an adjacent portion of the first side wall.

A14. The firearm cover of any of paragraphs A-A13, wherein the second lip extends toward the partially enclosed region relative to an adjacent portion of the second side wall.

A15. The firearm cover of any of paragraphs A-A14, further comprising:

an upper retainer operatively coupled to one of the first side wall and the second side wall and configured to be selectively extended across the longitudinal opening and temporarily coupled to the other of the first side wall and the second side wall to restrict removal of the firearm receiver from the partially enclosed region when the firearm receiver is operatively received in the partially enclosed region.

A16. The firearm cover of any of paragraphs A-A15, further comprising:

a rear retainer operatively coupled to one of the first side wall and the second side wall and configured to be selectively extended across the rear opening and temporarily coupled to the other of the first side wall and the second side wall to restrict removal of the firearm receiver from the partially enclosed region when the firearm receiver is operatively received in the partially enclosed region.

A17. The firearm cover of any of paragraphs A-A16, further comprising:

a front retainer operatively coupled to one of the first side wall and the second side wall and configured to be selectively extended across the forward opening and temporarily coupled to the other of the first side wall and the second side wall to restrict removal of the firearm receiver from the partially enclosed region when the firearm receiver is operatively received in the partially enclosed region.

A18. The firearm cover of any of paragraphs A-A17, further comprising:

at least one disabling structure configured to physically disable the firearm and prevent it from being fired when the firearm receiver is operatively received in the partially enclosed region, wherein at least one of:

the at least one disabling structure is defined by the body;

the at least one disabling structure is operatively coupled to the body; and the at least one disabling structure extends from the body.

A18.1. The firearm cover of paragraph A18, wherein the at least one disabling structure comprises a bolt restriction structure positioned to extend within an ejection port of the firearm when a bolt of the firearm is open and prevent closure of the bolt when the firearm receiver is operatively received in the partially enclosed region.

A18.1.1. The firearm cover of paragraph A18.1, wherein the bolt restriction structure extends from one of the first side wall and the second side wall into the partially enclosed region.

A18.2. The firearm cover of any of paragraphs A18-A18.1.1, wherein the at least one disabling structure comprises a charging handle restriction structure positioned to restrict movement of a charging handle of the firearm when the firearm receiver is operatively received in the partially enclosed region.

A18.2.1. The firearm cover of paragraph A18.2, wherein the charging handle restriction structure is positioned to restrict rearward movement of the charging handle when the firearm receiver is operatively received in the partially enclosed region and when the charging handle is positioned in its forward position.

A18.2.2. The firearm cover of paragraph A18.2, wherein the charging handle restriction structure is positioned to restrict forward movement of the charging handle when the firearm receiver is operatively received in the partially enclosed region and when the charging handle is positioned in its rearward position.

A18.3. The firearm cover of any of paragraphs A18-A18.2.2, wherein the firearm is a bolt action rifle, and wherein the at least one disabling structure comprises a bolt handle restriction structure positioned to restrict movement of a manual bolt handle of the bolt action rifle when the firearm receiver is operatively received in the partially enclosed region.

A18.3.1. The firearm cover of paragraph A18.3, wherein the bolt handle restriction structure is positioned to restrict closure of a bolt of the firearm when the bolt is open and when the firearm receiver is operatively received in the partially enclosed region.

A18.3.2. The firearm cover of paragraph A18.3, wherein the bolt handle restriction structure is positioned to restrict opening of a bolt of the firearm when the bolt is closed and when the firearm receiver is operatively received in the partially enclosed region.

A18.4. The firearm cover of any of paragraphs A18-A18.3.2, wherein the at least one disabling structure comprises a hammer restriction structure positioned to restrict movement of an external hammer of the firearm when the firearm receiver is operatively received in the partially enclosed region.

A18.4.1. The firearm cover of paragraph A18.4, wherein the hammer restriction structure is positioned to restrict movement of the external hammer from a cocked position toward a decocked position when the firearm receiver is operatively received in the partially enclosed region.

A18.4.2. The firearm cover of paragraph A18.4, wherein the hammer restriction structure is positioned to restrict movement of the external hammer from a decocked position toward a cocked position when the firearm receiver is operatively received in the partially enclosed region.

A18.4.3. The firearm cover of paragraph A18.4, wherein the hammer restriction structure is positioned to restrict movement of the external hammer from a half-cocked position toward both a cocked position and a decocked position when the firearm receiver is operatively received in the partially enclosed region.

A18.4.4. The firearm cover of any of paragraphs A18.4-A18.4.3, wherein at least one of the first lip and the second lip define a hammer notch positioned to receive the hammer when the firearm receiver is operatively received in the partially enclosed region.

A18.4.5. The firearm cover of any of paragraphs A18.4-A18.4.3, wherein hammer restriction structure physically covers the external hammer when the firearm receiver is operatively received in the partially enclosed region.

A18.4.6. The firearm cover of any of paragraphs A18.4-A18.4.5, wherein the firearm is a lever action rifle.

A18.4.6.1. The firearm cover of paragraph A18.4.6, wherein the first side wall and the second side wall are configured to cover a lever of the lever action rifle when the firearm receiver is operatively received in the partially enclosed region.

A18.4.6.2. The firearm cover of any of paragraphs A18.4-A18.4.6.1, wherein the at least one disabling structure extends between a/the lever of the lever action rifle and an adjacent body of the lever action rifle and prevents the lever from completing a reloading process when the firearm receiver is operatively received in the partially enclosed region.

A19. The firearm cover of any of paragraphs A-A18.4.6.2, further comprising:

at least one restricting structure configured to physically restrict the firearm from being fired when the firearm receiver is operatively received in the partially enclosed region, wherein at least one of:

the at least one restricting structure is defined by the body;

the at least one restricting structure is operatively coupled to the body; and the at least one restricting structure extends from the body.

A19.1. The firearm cover of paragraph A19, wherein the at least one restricting structure comprises a safety restriction structure positioned to restrict movement of a safety lever of the firearm when the firearm receiver is operatively received in the partially enclosed region.

A19.1.1. The firearm cover of paragraph A19.1, wherein the safety restriction structure comprises an elongate portion of one of the first side wall and the second side wall that extends rearward from an adjacent portion of the one of the first side wall and the second side wall.

A19.1.2. The firearm cover of any of paragraphs A19.1-A19.1.1, wherein the safety restriction structure comprises a first safety restriction structure on the first side wall and a second safety restriction structure on the second side wall.

A19.1.3. The firearm cover of paragraph A19.1, wherein the safety restriction structure comprises a safety lever notch in one of the first side wall and the second side wall, and wherein the safety lever extends through the safety lever notch when the firearm receiver is operatively received in the partially enclosed region.

A19.2. The firearm cover of any of paragraphs A19-A19.1.3, wherein the at least one restricting structure comprises a magazine well structure positioned to extend within a magazine well of the firearm when the firearm receiver is operatively received in the partially enclosed region and to prevent insertion of a magazine into the magazine well.

A19.2.1. The firearm cover of paragraph A19.2, wherein the magazine well structure extends from the connecting region into the partially enclosed region.

A19.2.2. The firearm cover of paragraph A19.2, wherein the magazine well structure extends from at least one of the first side wall and the second side wall and into the partially enclosed region.

A19.2.3. The firearm cover of any of paragraphs A19.2-A19.2.2, wherein the firearm receiver cannot be operatively received in the partially enclosed region if the magazine is positioned within the magazine well.

A20. The firearm cover of any of paragraphs A-A19.2.3, wherein the first side wall and the second side wall are configured to cover a trigger and a trigger guard of the firearm to prevent access to the trigger when the firearm receiver is operatively received in the partially enclosed region.

A21. The firearm cover of any of paragraphs A-A20, further comprising:

a barrel sheath operatively coupled to the body, wherein the barrel sheath comprises:

an elongate flexible portion operatively coupled to the body; and a muzzle cup operatively coupled to the elongate flexible portion and defining a muzzle volume for operatively receiving a muzzle of the firearm;

wherein the elongate flexible portion is sized to extend forward of the body along a barrel of the firearm and at least partially enclose the barrel when the firearm receiver is operatively received in the partially enclosed region and when the muzzle is operatively received in the muzzle volume.

A21.1. The firearm cover of paragraph A21, wherein the barrel sheath is configured to be selectively uncoupled from and recoupled to the body.

A21.2. The firearm cover of any of paragraphs A21-A21.1, wherein the elongate flexible portion is constructed of a stretchy material, optionally a fabric material, optionally an elastic material.

A21.3. The firearm cover of any of paragraphs A21-A21.2, wherein the elongate flexible portion defines an upper slit that extends at least partially along an upper side of the elongate flexible portion, and wherein the upper slit is sized to permit a firearm accessory coupled to the firearm to extend through the upper slit.

A21.3.1. The firearm cover of paragraph A21.3, wherein the firearm accessory comprises one or more of a scope, a sight, and a light.

A21.4. The firearm cover of any of paragraphs A21-A21.3.1, wherein the muzzle cup is constructed of a rigid or semi-rigid material.

A21.5. The firearm cover of any of paragraphs A21-A21.4, wherein the muzzle cup is constructed of a heat-resistant material.

A22. The firearm cover of any of paragraphs A-A21.5, wherein the body comprises an outer surface positioned opposite the partially enclosed region, and wherein the outer surface comprises highly conspicuous indicia.

A22.1. The firearm cover of paragraph A22, wherein the highly conspicuous indicia represents at least one disabling structure.

A23. The firearm cover of any of paragraphs A-A22.1, wherein the body comprises an/the outer surface positioned opposite the partially enclosed region, and wherein the outer surface has a highly conspicuous color.

A23.1. The firearm cover of paragraph A23, wherein the highly conspicuous color represents at least one disabling structure.

A24. The firearm cover of any of paragraphs A-A23.1, wherein the body only partially encloses the firearm receiver when the firearm receiver is operatively received in the partially enclosed region.

A25. The firearm cover of any of paragraphs A-A24, wherein the firearm cover encloses at most 90% of the firearm receiver when the firearm receiver is operatively received in the partially enclosed region.

A26. The firearm cover of any of paragraphs A-A25, wherein the firearm cover does not extend over a/the barrel of the firearm when the firearm receiver is operatively received in the partially enclosed region.

A27. The firearm cover of any of paragraphs A-A26, wherein the firearm cover does not extend over a stock of the firearm when the firearm receiver is operatively received in the partially enclosed region.

A28. The firearm cover of any of paragraphs A-A27, wherein the firearm cover is free of an external structure for operatively retaining the firearm on an article of clothing.

A29. The firearm cover of any of paragraphs A-A28, wherein the firearm cover is free of a belt clip.

A30. The firearm cover of any of paragraphs A-A29, wherein the body is shaped to conform to an outer surface of the firearm receiver when the firearm receiver is operatively received in the partially enclosed region.

A31. The firearm cover of any of paragraphs A-A30, wherein the firearm is one of an AR-pattern rifle, a magazine-fed rifle, a magazine-fed semi-automatic rifle, an AK-pattern rifle, a semi-automatic rifle, an automatic rifle, a long rifle, a hunting rifle, a bolt action rifle, a lever action rifle, a shotgun, a pump-action shotgun, a semi-automatic shotgun, a black powder rifle, and a muzzle-loader rifle.

A32. The firearm cover of any of paragraphs A-A31, wherein the body comprises a soft inner liner facing the partially enclosed region.

A32.1. The firearm cover of paragraph A32, wherein the soft inner liner is constructed of one or more of a fabric material, felt material, or leather.

A33. The firearm cover of any of paragraphs A-A32.1, further comprising the firearm, wherein the firearm receiver is operatively received in the partially enclosed region.

A34. A method of restricting firing of a firearm, the method comprising:

providing the firearm cover of any of paragraphs A-A33; and operatively positioning the firearm receiver in the partially enclosed region.

A34.1. The method of paragraph A34, wherein the operatively positioning disables the firearm.

A35. The use of the firearm cover of any of paragraphs A-A33 to restrict the firearm from being fired.

A36. The use of the firearm cover of any of paragraphs A-A33 to conspicuously restrict the firearm from being fired.

A37. The use of the firearm cover of any of paragraphs A-A33 to disable the firearm.

A38. The use of the firearm cover of any of paragraphs A-A33 to conspicuously disable the firearm.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A firearm cover, comprising:

a body defining a partially enclosed region sized and shaped to receive at least a portion of a firearm receiver of a firearm and configured to transition between a clamped conformation and an open conformation, wherein in the clamped conformation, the body is retained on the firearm receiver, wherein in the open conformation, the body is configured to be selectively placed over and removed from the firearm receiver, wherein the body is biased toward the clamped conformation, and wherein the body comprises:

a first side wall having a first lip, wherein the first side wall is configured to at least partially cover a first side of the firearm receiver when the firearm receiver is operatively received in the partially enclosed region;

a second side wall opposite the first side wall and having a second lip, wherein the second side wall is configured to at least partially cover a second side of the firearm receiver when the firearm receiver is received in the partially enclosed region, wherein the first lip and the second lip define a longitudinal opening to the partially enclosed region between the first lip and the second lip, wherein the first lip and the second lip are spaced further apart in the open conformation than in the clamped conformation, wherein the first side wall and the second side wall define a forward opening to the partially enclosed region and a rear opening to the partially enclosed region, and wherein, when the firearm receiver is operatively received in the partially enclosed region, the firearm extends through the forward opening and the rear opening; and a connecting region extending between the first side wall and the second side wall;

wherein the firearm cover further includes at least one disabling structure configured to physically disable the firearm and prevent it from being fired when the firearm receiver is operatively received in the partially enclosed region, wherein the at least one disabling structure comprises an edge defined by the first side wall of the body or the second side wall of the body, and wherein when the firearm receiver is operatively received in the partially enclosed region the edge is positioned to:

(i) at least one of (a) restrict rearward movement of a charging handle of the firearm when the charging handle is positioned in its forward position, and (b) restrict forward movement of the charging handle when the charging handle is positioned in its rearward position; or (ii) at least one of (b) restrict movement of a manual bolt handle of a bolt action rifle to restrict closure of a bolt of the firearm when the bolt is open, and (b) restrict movement of the manual bolt handle of the bolt action rifle to restrict opening of the bolt when the bolt is closed.

2. The firearm cover of claim 1, wherein the at least one disabling structure further comprises a bolt restriction structure that extends from one of the first side wall and the second side wall into the partially enclosed region, wherein the bolt restriction structure is positioned to extend within an ejection port of the firearm when the bolt of the firearm is open and prevent closure of the bolt when the firearm receiver is operatively received in the partially enclosed region.

3. The firearm cover of claim 1, wherein the at least one disabling structure further comprises a hammer restriction structure positioned to restrict movement of a hammer of the firearm when the firearm receiver is operatively received in the partially enclosed region.

4. The firearm cover of claim 1, further comprising:

at least one restricting structure configured to physically restrict the firearm from being fired when the firearm receiver is operatively received in the partially enclosed region, wherein at least one of:

the at least one restricting structure is defined by the body;

the at least one restricting structure is operatively coupled to the body; and the at least one restricting structure extends from the body.

5. The firearm cover of claim 4, wherein the at least one restricting structure comprises a safety restriction structure positioned to restrict movement of a safety lever of the firearm when the firearm receiver is operatively received in the partially enclosed region.

6. The firearm cover of claim 4, wherein the at least one restricting structure comprises a magazine well structure that extends from the body into the partially enclosed region and that is positioned to extend within a magazine well of the firearm when the firearm receiver is operatively received in the partially enclosed region and to prevent insertion of a magazine into the magazine well.

7. The firearm cover of claim 6, wherein the firearm receiver cannot be operatively received in the partially enclosed region if the magazine is positioned within the magazine well.

8. The firearm cover of claim 1, wherein the first side wall and the second side wall are configured to cover a trigger and a trigger guard of the firearm to prevent access to the trigger when the firearm receiver is operatively received in the partially enclosed region.

9. The firearm cover of claim 1, further comprising:

a barrel sheath operatively coupled to the body, wherein the barrel sheath comprises:

an elongate flexible portion operatively coupled to the body; and a muzzle cup operatively coupled to the elongate flexible portion and defining a muzzle volume for operatively receiving a muzzle of the firearm;

wherein the elongate flexible portion is sized to extend forward of the body along a barrel of the firearm and at least partially enclose the barrel when the firearm receiver is operatively received in the partially enclose region and when the muzzle is operatively received in the muzzle volume.

10. The firearm cover of claim 1, wherein the body is constructed of a semi-rigid, flexible material with an internal bias that biases the body toward the clamped conformation.

11. A firearm cover, comprising:

a body defining a partially enclosed region sized and shaped to receive at least a portion of a firearm receiver of a firearm and configured to transition between a clamped conformation and an open conformation, wherein in the clamped conformation, the body is retained on the firearm receiver, wherein in the open conformation, the body is configured to be selectively placed over and removed from the firearm receiver, wherein the body is biased toward the clamped conformation, and wherein the body comprises:

a first side wall having a first lip, wherein the first side wall is configured to at least partially cover a first side of the firearm receiver when the firearm receiver is operatively received in the partially enclosed region;

a second side wall opposite the first side wall and having a second lip, wherein the second side wall is configured to at least partially cover a second side of the firearm receiver when the firearm receiver is received in the partially enclosed region, wherein the first lip and the second lip define a longitudinal opening to the partially enclosed region between the first lip and the second lip, wherein the first lip and the second lip are spaced further apart in the open conformation than in the clamped conformation, wherein the first side wall and the second side wall define a forward opening to the partially enclosed region and a rear opening to the partially enclosed region, and wherein, when the firearm receiver is operatively received in the partially enclosed region, the firearm extends through the forward opening and the rear opening; and a connecting region extending between the first side wall and the second side wall;

wherein the firearm cover further includes a barrel sheath operatively coupled to the body, wherein the barrel sheath comprises:

an elongate flexible portion operatively coupled to the body; and a muzzle cup operatively coupled to the elongate flexible portion and defining a muzzle volume for operatively receiving a muzzle of the firearm;

wherein the elongate flexible portion is sized to extend forward of the body along a barrel of the firearm and at least partially enclose the barrel when the firearm receiver is operatively received in the partially enclosed region and when the muzzle is operatively received in the muzzle volume;

wherein the barrel sheath is configured to be selectively uncoupled from and recoupled to the body; and wherein the elongate flexible portion is configured to be received in the muzzle volume for storage of the barrel sheath when uncoupled from the body.

12. A firearm cover, comprising:

a body defining a partially enclosed region sized and shaped to receive at least a portion of a firearm receiver of a firearm and configured to transition between a clamped conformation and an open conformation, wherein in the clamped conformation, the body is retained on the firearm receiver, wherein in the open conformation, the body is configured to be selectively placed over and removed from the firearm receiver, wherein the body is biased toward the clamped conformation, and wherein the body comprises:

a first side wall having a first lip, wherein the first side wall is configured to at least partially cover a first side of the firearm receiver when the firearm receiver is operatively received in the partially enclosed region;

a second side wall opposite the first side wall and having a second lip, wherein the second side wall is configured to at least partially cover a second side of the firearm receiver when the firearm receiver is received in the partially enclosed region, wherein the first lip and the second lip define a longitudinal opening to the partially enclosed region between the first lip and the second lip, wherein the first lip and the second lip are spaced further apart in the open conformation than in the clamped conformation, wherein the first side wall and the second side wall define a forward opening to the partially enclosed region and a rear opening to the partially enclosed region, and wherein, when the firearm receiver is operatively received in the partially enclosed region, the firearm extends through the forward opening and the rear opening; and a connecting region extending between the first side wall and the second side wall;

wherein the firearm cover further comprises at least one restricting structure configured to physically restrict the firearm from being fired when the firearm receiver is operatively received in the partially enclosed region, wherein the at least one restricting structure comprises a safety restriction structure, wherein the safety restriction structure comprises an edge defined by the first side wall of the body or the second side wall of the body, and wherein the edge is positioned to restrict movement of a safety lever of the firearm when the firearm receiver is operatively received in the partially enclosed region.

13. The firearm cover of claim 12, further comprising:

at least one disabling structure configured to physically disable the firearm and prevent it from being fired when the firearm receiver is operatively received in the partially enclosed region, wherein at least one of:

the at least one disabling structure is defined by the body;

the at least one disabling structure is operatively coupled to the body; and the at least one disabling structure extends from the body;

wherein the at least one disabling structure comprises a bolt restriction structure that extends from one of the first side wall and the second side wall into the partially enclosed region, wherein the bolt restriction structure is positioned to extend within an ejection port of the firearm when a bolt of the firearm is open and prevent closure of the bolt when the firearm receiver is operatively received in the partially enclosed region.

14. The firearm cover of claim 12, further comprising:

at least one disabling structure configured to physically disable the firearm and prevent it from being fired when the firearm receiver is operatively received in the partially enclosed region, wherein at least one of:

the at least one disabling structure is defined by the body;

the at least one disabling structure is operatively coupled to the body; and the at least one disabling structure extends from the body;

wherein the at least one disabling structure comprises a charging handle restriction structure positioned to restrict movement of a charging handle of the firearm when the firearm receiver is operatively received in the partially enclosed region, wherein the charging handle restriction structure is positioned to at least one of:

restrict rearward movement of the charging handle when the firearm receiver is operatively received in the partially enclosed region and when the charging handle is positioned in its forward position; and restrict forward movement of the charging handle when the firearm receiver is operatively received in the partially enclosed region and when the charging handle is positioned in its rearward position.

15. The firearm cover of claim 12, further comprising:

at least one disabling structure configured to physically disable the firearm and prevent it from being fired when the firearm receiver is operatively received in the partially enclosed region, wherein at least one of:

the at least one disabling structure is defined by the body;

the at least one disabling structure is operatively coupled to the body; and the at least one disabling structure extends from the body;

wherein the at least one disabling structure comprises a bolt handle restriction structure positioned to restrict movement of a manual bolt handle of a bolt action rifle when the firearm receiver is operatively received in the partially enclosed region, wherein the bolt handle restriction structure is positioned to at least one of:

restrict closure of a bolt of the firearm when the bolt is open and when the firearm receiver is operatively received in the partially enclosed region; and restrict opening of a bolt of the firearm when the bolt is closed and when the firearm receiver is operatively received in the partially enclosed region.

16. The firearm cover of claim 12, further comprising:

at least one disabling structure configured to physically disable the firearm and prevent it from being fired when the firearm receiver is operatively received in the partially enclosed region, wherein at least one of:

the at least one disabling structure is defined by the body;

the at least one disabling structure is operatively coupled to the body; and the at least one disabling structure extends from the body;

wherein the at least one disabling structure comprises a hammer restriction structure positioned to restrict movement of a hammer of the firearm when the firearm receiver is operatively received in the partially enclosed region.

17. The firearm cover of claim 12, wherein the first side wall and the second side wall are configured to cover a lever of a lever action rifle when the firearm receiver is operatively received in the partially enclosed region.

18. The firearm cover of claim 12, wherein the at least one restricting structure further comprises a magazine well structure that extends from the body into the partially enclosed region and that is positioned to extend within a magazine well of the firearm when the firearm receiver is operatively received in the partially enclosed region and to prevent insertion of a magazine into the magazine well; and wherein the firearm receiver cannot be operatively received in the partially enclosed region if the magazine is positioned within the magazine well.

19. The firearm cover of claim 12, wherein the first side wall and the second side wall are configured to cover a trigger and a trigger guard of the firearm to prevent access to the trigger when the firearm receiver is operatively received in the partially enclosed region.

20. The firearm cover of claim 12, further comprising:

a barrel sheath operatively coupled to the body, wherein the barrel sheath comprises:

an elongate flexible portion operatively coupled to the body; and a muzzle cup operatively coupled to the elongate flexible portion and defining a muzzle volume for operatively receiving a muzzle of the firearm;

wherein the elongate flexible portion is sized to extend forward of the body along a barrel of the firearm and at least partially enclose the barrel when the firearm receiver is operatively received in the partially enclosed region and when the muzzle is operatively received in the muzzle volume.

21. The firearm cover of claim 12, wherein the edge is of an elongate portion on one of the first side wall and the second side wall that extends rearward from an adjacent portion of the first side wall or the second side wall.

22. The firearm cover of claim 1, wherein the edge is of a generally vertical slot defined in one of the first side wall of the body or the second side wall of the body.

23. A firearm cover, comprising:

a body defining a partially enclosed region sized and shaped to receive at least a portion of a firearm receiver of a firearm and configured to transition between a clamped conformation and an open conformation, wherein in the clamped conformation, the body is retained on the firearm receiver, wherein in the open conformation, the body is configured to be selectively placed over and removed from the firearm receiver, wherein the body is biased toward the clamped conformation, and wherein the body comprises:

a first side wall having a first lip, wherein the first side wall is configured to at least partially cover a first side of the firearm receiver when the firearm receiver is operatively received in the partially enclosed region;

a second side wall opposite the first side wall and having a second lip, wherein the second side wall is configured to at least partially cover a second side of the firearm receiver when the firearm receiver is received in the partially enclosed region, wherein the first lip and the second lip define a longitudinal opening to the partially enclosed region between the first lip and the second lip, wherein the first lip and the second lip are spaced further apart in the open conformation than in the clamped conformation, wherein the first side wall and the second side wall define a forward opening to the partially enclosed region and a rear opening to the partially enclosed region, and wherein, when the firearm receiver is operatively received in the partially enclosed region, the firearm extends through the forward opening and the rear opening; and a connecting region extending between the first side wall and the second side wall;

wherein the firearm cover further comprises a safety restriction structure, wherein the safety restriction structure is configured to engage and move a safety of the firearm when the firearm cover is operatively placed on the firearm and the firearm receiver is operatively received in the partially enclosed region.

* * * * *